US010947605B2

(12) United States Patent
Renner et al.

(10) Patent No.: US 10,947,605 B2
(45) Date of Patent: Mar. 16, 2021

(54) METHOD FOR HYDROPHOBISING LEATHER, AND LEATHER PRODUCED BY MEANS OF SAME

(71) Applicants: FRAUNHOFER-GESELLSCHAFT ZUR FÖRDERUNG DER ANGEWANDTEN FORSCHUNG E.V., Munich (DE); RUHR-UNIVERSITAET BOCHUM, Bochum (DE)

(72) Inventors: Manfred Renner, Essen (DE); Andreas Sengespeick, Oberhausen (DE); Michael Prokein, Oberhausen (DE); Eckhard Weidner, Bochum (DE)

(73) Assignee: FRAUNHOFER-GESELLSCHAFT ZUR FORDERUNG DER ANGEWAND, Bochum (DE)

( * ) Notice: Subject to any disclaimer, the term of this patent is extended or adjusted under 35 U.S.C. 154(b) by 40 days.

(21) Appl. No.: 16/069,390

(22) PCT Filed: Jan. 12, 2017

(86) PCT No.: PCT/EP2017/050548

§ 371 (c)(1),
(2) Date: Jul. 11, 2018

(87) PCT Pub. No.: WO2017/121789

PCT Pub. Date: Jul. 20, 2017

(65) Prior Publication Data

US 2019/0017129 A1 Jan. 17, 2019

(30) Foreign Application Priority Data

Jan. 12, 2016 (DE) ..... 102016000243.3

(51) Int. Cl.
*C14C 9/00* (2006.01)

(52) U.S. Cl.
CPC ..... *C14C 9/00* (2013.01)

(58) Field of Classification Search
None
See application file for complete search history.

(56) References Cited

U.S. PATENT DOCUMENTS

| | | | |
|---|---|---|---|
| 5,512,058 | A | 4/1996 | Gavend et al. |
| 2005/0214464 | A1 | 9/2005 | Moriyoshi et al. |

FOREIGN PATENT DOCUMENTS

| | | | |
|---|---|---|---|
| DE | 4202320 | A1 | 8/1993 |
| DE | 4404890 | | 8/1995 |
| DE | 19507572 | | 9/1996 |
| DE | 10306748 | A1 | 8/2004 |
| DE | 102005012329 | A1 | 9/2006 |
| DE | 102006008190 | | 8/2007 |
| DE | 102006027400 | A1 | 12/2007 |
| EP | 0193832 | A1 | 9/1986 |
| EP | 0213480 | A2 | 3/1987 |
| EP | 0342345 | A2 | 11/1989 |
| EP | 1416057 | A1 | 5/2004 |
| WO | 2011066830 | | 6/2011 |

OTHER PUBLICATIONS

Machine Translation of DE 102006008190 A1 (Year: 2007).*
Database WPI WEek 201580, Thomson Scientific, London, GB, AN 2015-61301G, XP002766790, & CN 104846134A, Qingdao Qiyuan Zhendong Electric Co LTD, Aug. 19, 2015.
German language International Search Report and Written Opinion, dated Mar. 6, 2017, 13 pages.
English language translation of International Search Report, dated Mar. 6, 2017, 3 pages.
German language International Preliminary Report on Patentability, dated Feb. 1, 2018, 15 pages.
German language Search Results, dated Sep. 5, 2016, 3 pages.

* cited by examiner

*Primary Examiner* — Shamim Ahmed
*Assistant Examiner* — Bradford M Gates
(74) *Attorney, Agent, or Firm* — Barnes & Thornburg LLP

(57) ABSTRACT

The invention relates to a method for hydrophobising leather, comprising the steps:

providing tanned, at least partly dried leather whose content of free water is in the range of from 0 to 25 wt. %, based on the weight of the dried leather, treating the leather with a mixture of compressed gas and a hydrophobising agent at a pressure of at least 30 bar in a pressure vessel, and relieving the pressure of the pressure vessel to ambient pressure.

By using the method according to the invention it is possible to obtain leather which is hydrophobised at the surface, as well as thick and firm, deeply hydrophobised leather, as is used, for example, for shoe soles.

19 Claims, No Drawings

METHOD FOR HYDROPHOBISING LEATHER, AND LEATHER PRODUCED BY MEANS OF SAME

CROSS REFERENCE TO RELATED APPLICATIONS

This application is the U.S. national phase of PCT/US2016/062181 filed Nov. 16, 2016. PCT/US2016/062181 claims the benefit of and priority to U.S. provisional patent application Ser. No. 62/257,539 filed Nov. 19, 2015, the disclosure of which is expressly incorporated herein by reference.

The present invention relates to a method for hydrophobising leather, and to leather produced thereby.

Within the context of the following disclosure, the term "leather" is understood as meaning tanned collagen-containing material with and without hair, which has been obtained by a preceding tanning process. The term "leather" accordingly includes not only leather as such but also furs and hides produced from animal skins or hides. The leather can come from any animals, for example from cattle, sheep, goats, pigs, buffalo, birds, reptiles, etc. The tanning process by which the leather is obtained can be a mineral, vegetable or synthetic tanning process, according to the type of tannins used for the tanning (mineral salts, vegetable tannins, synthetic tannins). The term "leather" further includes leather of any thickness, for example particularly thin bag makers' leather but also very thick sole leather.

Conventional tanning processes for producing leather comprise a number of aqueous baths in which the raw material is treated in order to become leather. These aqueous baths are divided into the operations in the so-called beamhouse, the actual tanning as well as retanning. The aqueous baths accordingly cover all the process steps which are performed in an aqueous medium to produce leather. These include, for example, soaking, unhairing (liming), pickling, tanning, retanning, oiling, dyeing, etc. The individual treatment processes within the context of this leather production are well known to experts in the field and therefore do not require further explanation.

As soon as the skins tanned by means of the various treatment steps are dried, they are "leather" within the context of the present disclosure. Tanned, treated and dried collagen-containing material before the "crust" state is thus also "leather". In the tanning industry, "crust" denotes the state of an animal skin before so-called finishing, that is to say before the final surface appearance applied to the surface.

Accordingly, in particular tanned, treated and dried collagen-containing material which has not yet been subjected to any mechanical operations after drying, such as, for example, staking or milling, is also regarded as "leather" within the context of this invention.

Freshly tanned leather is wet or at least moist and must be dried. There are used for this purpose so-called tunnel driers, for example, in which the leather is dried by means of elevated temperature, or also so-called vacuum driers, in which the leather is dried by application of low pressure, optionally likewise at elevated temperature. Even in the dried state, however, the leather contains bound water. Excessive drying, which would also remove some or even all of the water bound in the leather, is undesirable because it would result in embrittlement and degeneration of the leather. Excessively dried leather becomes brittle and thus unusable. Within the context of the present disclosure, "dry leather" is therefore understood as being tanned collagen-containing material which has been dried for at least 48 hours at 50° C. and thus no longer contains any free water but only water bound in the leather. When "dry leather" is mentioned within the context of this disclosure, this dry leather has, by definition, a water content of 0 wt. %, although it still contains water bound in the leather. The expression "elevated water content" is used within the context of this disclosure when the leather contains more water than the water that is present bound in the leather following the described drying, that is to say when free water is present in the leather.

Collagen-containing material, and thus the skins used as the raw material for leather production, naturally has a certain proportion of ionisable and non-ionisable functional groups. In the course of the leather production process, the proportion of these groups changes in dependence on the chemicals used. For example, in the case of chrome tanning, the proportion of acidic carboxy groups is reduced. If vegetable tannins are used for tanning, then the proportion of OH groups increases significantly owing to the hydroxyl groups present in the vegetable tannins. Because of the natural origin of collagen-containing material and a large number of different leather chemicals which can be used within the context of the leather production process, it is not possible to give a universally applicable indication of the proportions of the functional groups that are present, and thus also of the water that is later still bound in the leather after drying.

Leather is mainly used nowadays in the shoe and clothing industry, in the automotive industry and in the furniture industry. In the mentioned fields of application, leather is increasingly required to be water-repellent, that is to say to have high resistance to the penetration of water. Unfortunately, leather, in particular vegetable-tanned leather, is hydrophilic, so that the required water-repellent properties represent a major challenge for the leather industry.

In order to improve the water-repellent properties of collagen-containing materials, it is already known to introduce hydrophobic substances such as oils, fats, waxes, paraffins, fluorocarbons and hydrophobised polymers into the leather structure.

Conventionally this takes place in the aqueous medium, before, during or after retanning, using emulsifiers which allow the water-insoluble hydrophobising agents to be distributed sufficiently finely in the aqueous phase. The emulsions must be broken up in a subsequent process step in order to allow the water-insoluble hydrophobising agents to be incorporated into the leather. In these known processes, a significant proportion of the chemicals used is not fixed or incorporated in the collagen and thus remains in the waste water. This not only pollutes the environment but also leads to increased costs for chemicals which are to be used in excess and subsequent process steps for waste-water treatment.

Moreover, known methods for hydrophobising leather not only improve the water-repellent properties of the leather but also increase its softness. Sometimes this is a positive side-effect, but in other cases it is a disadvantage, for example in the case of products which require a certain firmness, such as, for example, shoe soles. Furthermore, in particular leather products which require high firmness are produced using a high proportion of hydrophilic vegetable tannins, which are incorporated in the leather and prevent or at least greatly impede the provision of water-repellent properties by means of conventional hydrophobising methods. It has therefore not hitherto been known to hydrophobise in particular vegetable-tanned and/or synthetically tanned leather permanently and completely, that is to say throughout.

Systems for hydrophobisation which are applied only superficially fail quickly under relatively high mechanical loading, such as occurs, for example, in the field of shoe leather, and therefore do not represent a satisfactory solution.

The object of the present invention is to provide a method for hydrophobising leather which permits long-term stable and complete hydrophobisation, in a manner which is readily reproducible in terms of process engineering, of vegetable-tanned and/or synthetically tanned leather in particular, so that it is possible by means of this method to produce also deeply hydrophobised leather which can be used, for example, as leather for shoe soles.

This object is achieved according to the invention by a method for hydrophobising leather which has the following steps:

providing tanned, at least partly dried leather whose content of free water is in the range of from 0 to 25 wt. %, based on the weight of the dried leather, treating the leather with a mixture of compressed gas and a hydrophobising agent at a pressure of at least 30 bar in a pressure vessel, and relieving the pressure of the pressure vessel to ambient pressure.

The mixture used for treating the leather does not have to be fed to the pressure vessel as such but may merely form upon treatment. The hydrophobising agent can be fed to the pressure vessel before pressure build-up, during pressure build-up, during a pressure holding time or also during pressure relief of the pressure vessel. The hydrophobising agent can also be brought into contact with the leather to be treated before the leather is introduced into the pressure vessel. What is important is merely that a mixture of the compressed gas and the hydrophobising agent forms during treatment of the leather. In other words, the hydrophobising agent used must be at least partially soluble in the compressed gas.

In the method for hydrophobising leather according to the invention, compressed $CO_2$ is preferably used as the compressed gas. However, other compressed gases can also be used alternatively or in addition within the context of the invention, for example carbon monoxide, ethane, propane, pentane, ammonia, fluoro-chloro-alkanes and mixtures of these substances. Owing to the low viscosity and excellent diffusion property of the compressed gas, the hydrophobising agent dissolved in the compressed gas is able to penetrate even thick leather completely and thus achieve deep hydrophobisation. The penetration behaviour of the hydrophobising agent dissolved in the compressed gas can be controlled especially via the treatment time so that, by means of a suitable, relatively short treatment time, it is also possible to hydrophobise only layers of the leather that are close to the surface, if so desired.

There can be used as hydrophobising agents reactive polymers, hydrocarbons, silanes, silanols and siloxanes, which preferably contain one or more functional groups of the epoxide, ester, carboxyl, anhydride, amine, hydroxide and/or halide type. Particular preference is given according to the present invention to the use of a hydrophobising agent which consists of at least one silane and/or silanol and/or siloxane. It has been found especially that compounds of the type alkylsilanol, alkoxysilane, alkylchlorosilane and organofunctionalised silanes are excellently suitable as hydrophobising agents in the method according to the invention. They can be monofunctional, difunctional and/or trifunctional compounds. In general, these compounds have the general form $R_{1(1-3)}R_{2(0-2)}$—$SiX_{(1-3)}$, wherein $R_1$ denotes a hydrophobic group, $R_2$ denotes an organically functionalised radical and X denotes a hydrolysable group, mostly an alkoxy group, more rarely also a chlorine group. By means of hydrolysis reactions with water, such compounds form silanols having the form $R_{(1-3)}$—$Si(OH)_{(1-3)}$. The organically functionalised $R_2$ groups can additionally contain functional groups which are capable of forming covalent bonds with the hydroxyl groups as well as the carboxyl and amino groups of the leather. Such additional functional groups can be amino, epoxide, ester and carboxy groups. Examples of compounds having such additional functional groups are 3-aminopropyl-trimethoxysilane, 3-ureidopropyltrimethoxysilane and 3-glycidoxypropyltrimethoxysilane.

Among the alkoxysilanes, alkylmethoxysilanes, wherein alkyl represents $C_1$- to $C_{20}$-alkyl, are particularly preferred as hydrophobising agents. Examples of such particularly preferred alkylmethoxysilanes are dialkylmethoxysilane, alkyltrimethoxysilane and mixtures of these substances. Most particular preference is given to hexadecyltrimethoxysilane, isooctyltrimethoxysilane, dimethyldiethoxysilane, phenyltriethoxysilane or mixtures of the above-mentioned substances.

Alkylalkoxysilanes and also alkylchlorosilanes hydrolyse in the presence of water to alkylsilanols, which can polymerise, with the separation of water, or can bind to nucleophilic reagents such as, for example, hydroxyl groups, carboxyl groups and/or amino groups. In this manner, the hydrophobising agent is fixed in the leather or incorporated into the leather, whereby the desired long-term stable hydrophobisation which is insensitive to mechanical stress of the leather is achieved.

When silanols are used as the hydrophobising agent, in particular alkylsilanols such as, for example, methylsilanoltriol, diphenylsilanediol and/or trimethylsilanol, the above-described hydrolysis step can be omitted. Leather with a low or even no residual water content can therefore readily be hydrophobised with silanols, in particular alkylsilanols.

After the leather has been treated with the mixture of compressed gas and hydrophobising agent, the compressed gas is relieved to ambient pressure and hydrophobising agent that is not fixed in the leather is eliminated. The gas used, as well as the excess hydrophobising agent separated from the gas, can be used again. Waste-water purification is not necessary since no waste water at all is formed in the method of hydrophobising leather according to the invention.

The main advantage of the method according to the invention is to be seen in the possibility of the long-term stable hydrophobisation of a large variety of products of collagen materials, irrespective of the type of starting material and irrespective of the type of leather production method. For example, both soft chrome leather and vegetable-tanned and/or synthetically tanned leather of high firmness can be hydrophobised by the hydrophobising method according to the invention. Conventional hydrophobising methods, on the other hand, work only for specific product groups. Additional auxiliary chemicals, which are necessary in conventional hydrophobising methods, are not required in the method according to the invention. Furthermore, the results obtained by using the method according to the invention are highly reproducible, whereas even established hydrophobising methods for chrome leather suffer from limited reproducibility.

In contrast to conventional closed systems for hydrophobisation, the vapour permeability of the hydrophobised products is not impaired by the use of the method according to the invention because spaces between fibres are not blocked but the hydrophobising agent purposively enters into fixed chemical bonds with the collagen and/or the substances bound in the collagen. Furthermore, the hydrophobising agent is able to crosslink with itself according to the invention and thus form a hydrophobic network in the leather.

In contrast to conventional methods of hydrophobising leather, the hydrophobisation in the method according to the invention is not carried out during the process steps which in conventional leather production take place in aqueous baths. Instead, according to the invention, the intermediate product "leather", which has been obtained from a leather production process of any kind, is hydrophobised.

In order that the hydrophobising agent is able to be incorporated into the leather in the described manner in the method according to the invention, the water content of the leather, that is to say the content of free water, must be between 0 wt. % and 25 wt. %. As already mentioned, the indication of a water content of 0 wt. % does not mean that the leather no longer contains any water at all but that only bound water, but no free water, is present in the leather. The indication "25 wt. % water content" accordingly means that free water is still present in the leather, in addition to the bound water, in a proportion which corresponds to a quarter of the total weight of the dry leather. If, for example, a piece of leather in the dry state (water content 0 wt. %) weighs 1 kg, then the same piece of leather with a water content of 25 wt. % weighs 1.25 kg. A larger proportion of water is not advantageous because it reduces the ability of the compressed gas to penetrate the leather. At water contents above 25 wt. %, the solubility of the compressed gas in water increasingly plays an important role, since the compressed gas must then first dissolve in the water in the leather in order to be able to penetrate the leather. However, because of the natural structure of leather, this process takes place only slowly and to a limited extent, so that deep hydrophobisation is prevented.

Depending on the leather used as the starting material and on the hydrophobising agent used, the quality of the hydrophobisation can be improved if the leather that is provided contains not only bound water but also a certain proportion of free water, which, however, should not exceed 25 wt. %. Accordingly, in the method according to the invention, the water content of the leather before the leather is introduced into the pressure vessel or following treatment in the pressure vessel can be adjusted to a value between 0 and 25 wt. %. Alternatively, the water content of the leather can also be adjusted to a value between 0 and 25 wt. % in the pressure vessel.

The ways in which an elevated water content can be established in the leather are many and varied. For example, a desired, elevated water content in the leather can be achieved simply by not drying the leather in the drying operation to such an extent that only bound water is present in the leather. Instead, the process of drying the leather can be terminated when the desired, elevated water content of between 0 and 25 wt. % has been reached. When the starting product is leather having a water content of 0 wt. % and an elevated water content is desired, the increase in the water content can be achieved, for example, by treating the dry leather in a climatic chamber in which there is sufficient atmospheric moisture that the dry leather absorbs moisture from the air. The dry leather can also be sprayed or sprinkled with water. A further possibility consists in feeding steam or saturated steam into a vessel in which the dry leather is situated. Yet a further possibility consists in dissolving water in the compressed gas used to treat the leather. The desired, elevated water content can accordingly be established during feeding of the compressed gas into the pressure vessel, either by dissolving water in the compressed gas to be fed in or by introducing water into the pressure vessel separately while the compressed gas is being fed in. However, an elevated water content can also be established after the compressed gas has been introduced into the pressure vessel, either during a pressure holding time or during pressure relief of the pressure vessel, or only once the pressure of the pressure vessel has been relieved.

The hydrophobising agent used in the method according to the invention is fed to the pressure vessel preferably before pressure build-up, during pressure build-up, during a pressure holding time or during pressure relief of the pressure vessel. Feeding can take place, for example, by placing the hydrophobising agent in a supply chamber connected to the pressure vessel, by pumping, by atomisation and/or by dissolving the hydrophobising agent in the compressed gas beforehand. It is also possible, although not preferred, to apply the hydrophobising agent before the leather is introduced into the pressure vessel, for example by pouring it onto the leather or by spraying the leather.

It is likewise possible to feed in different hydrophobising agents in succession.

The mixture of compressed gas and the hydrophobising agent used, that is to say the dissolution of the hydrophobising agent in the compressed gas, takes place, independently of the desired type of hydrophobisation, solely as a result of the presence of the compressed gas. The parameters pressure and temperature, which influence the dissolution of the hydrophobising agent in the compressed gas, vary according to the hydrophobising agent used. According to the invention, the treatment of the leather advantageously takes place at a pressure of from 30 to 300 bar, preferably at a pressure of from 50 to 250 bar and particularly preferably at a pressure of from 70 to 200 bar. The pressure that is most suitable for a given hydrophobising agent and a given hydrophobising task is optionally to be determined by series of tests.

According to the invention, the treatment of the leather advantageously takes place at a temperature of from 10° C. to 150° C., preferably at a temperature of from 20° C. to 130° C. and particularly preferably at a temperature of from 30° C. to 110° C., the temperature range from 60° C. to 80° C. in particular having been found to be particularly suitable. Here too, the most suitable temperature for a given hydrophobising agent and a given hydrophobising task is optionally to be determined by tests.

As already mentioned, the depth of penetration of the hydrophobising agent can be controlled especially via the treatment time. It is obvious that thin leathers require a shorter treatment time until the hydrophobising agent has penetrated completely than do thick leathers. According to the invention, the treatment of the leather advantageously takes place for a period of from 5 minutes to 10 hours, preferably for from 10 minutes to 5 hours and particularly preferably for from 30 minutes to 4 hours.

By using the method according to the invention it is possible to obtain leather which is hydrophobised at the surface, as well as thick and firm, deeply hydrophobised leather, as is used, for example, for shoe soles.

The invention claimed is:

1. A method for hydrophobising leather, comprising the steps:

providing tanned, partly dried leather in which bound water is retained and in which a content of free water is in the range of from 0 to 25 wt. %, based on the weight of the dried leather, treating the leather with a mixture of compressed gas and a hydrophobising agent at a pressure of at least 30 bar in a pressure vessel, and relieving the pressure of the pressure vessel to ambient pressure.

2. The method for hydrophobising leather according to claim 1, further comprising adjusting the content of free water to a value between 0 and 25 wt. % before the leather is introduced into the pressure vessel or following treatment in the pressure vessel.

3. The method for hydrophobising leather according to claim 1, further comprising adjusting the content of free water to a value between 0 and 25 wt. % in the pressure vessel.

4. The method for hydrophobising leather according to claim 3, further comprising feeding the compressed gas into the pressure vessel, wherein the adjustment of the content of free water takes place before the compressed gas is fed into the pressure vessel, during feeding of the compressed gas into the pressure vessel or after the compressed gas has been fed into the pressure vessel.

5. The method for hydrophobising leather according to claim 4, characterised in that, when the adjustment of the content of free water takes place during or after the feeding of the compressed gas into the pressure vessel, the adjustment takes place together with the introduction of the compressed gas or after the introduction of the compressed gas into the pressure vessel, either during a pressure holding time or during pressure relief of the pressure vessel or after pressure relief of the pressure vessel.

6. The method for hydrophobising leather according to claim 1, further comprising feeding the at least one hydrophobising agent into the pressure vessel, wherein the feeding of the at least one hydrophobising agent into the pressure vessel takes place before a pressure build-up, during pressure build-up, during a pressure holding time or during pressure relief of the pressure vessel.

7. The method for hydrophobising leather according to claim 1, further comprising supplying the hydrophobising agent in the form of at least one of silane, silanol and siloxane.

8. The method for hydrophobising leather according to claim 7, characterised in that the at least one silane is selected from the group of alkoxysilanes, alkylchlorosilanes or organofunctionalised silanes.

9. The method for hydrophobising leather according to claim 8, characterised in that the at least one silane is one of a dialkyldimethoxysilane, an alkyltrimethoxysilane or a mixture thereof.

10. The method for hydrophobising leather according to claim 8, characterised in that the at least one silane is one of hexadecyltrimethoxysilane, isooctyltrimethoxysilane, dimethyldiethoxysilane, phenyltriethoxysilane or a mixture thereof.

11. The method for hydrophobising leather according to claim 7, characterised in that the at least one silanol is an alkylsilanol.

12. The method for hydrophobising leather according to claim 11, characterised in that the at least one silanol is one of methylsilanetriol, diphenylsilanediol, trimethylsilanol or a mixture thereof.

13. The method for hydrophobising leather according to claim 1, characterised in that the compressed gas is one of CO, $CO_2$, ethane, propane, pentane, ammonia, a fluorochloro-alkane or a mixture of two or more of these substances.

14. The method for hydrophobising leather according to claim 1, characterised in that treating the leather at a pressure of at least 30 bar comprises treating the leather at a pressure of from 30 to 300 bar.

15. The method for hydrophobising leather according to claim 14, characterised in that treating the leather at a pressure of from 30 to 300 bar comprises treating the leather at a pressure of from 70 to 200 bar.

16. The method for hydrophobising leather according to claim 1, characterised in that treating the leather further comprises treating the leather at a temperature of from 10° C. to 150° C.

17. The method for hydrophobising leather according to claim 16, characterised in that treating the leather at a temperature of from 10° C. to 150° C. comprises treating the leather at a temperature of from one of 20° C. to 130° C., 30° C. to 110° C. or 60° C. to 80° C.

18. The method for hydrophobising leather according to claim 1, characterised in that treating the leather further comprises treating the leather for a period of from 5 minutes to 10 hours.

19. The method for hydrophobising leather according to claim 18, characterised in that treating the leather for a period of from 5 minutes to 10 hours comprises treating the leather for a period of for one of from 10 minutes to 5 hours or 30 minutes to 4 hours.

* * * * *